US007356850B2

(12) United States Patent
Turcotte et al.

(10) Patent No.: US 7,356,850 B2
(45) Date of Patent: Apr. 15, 2008

(54) PROTECTIVE GARMENT HAVING A DRAG AND RESCUE DEVICE ACCESSIBLE FROM THE COLLAR

(75) Inventors: Mélanie Turcotte, Anjou (CA); Josée Lalonde, St-Louis de Gonzague (CA)

(73) Assignee: Bacou-Dalloz Protective Apparel Ltd., Montreal, Quebec (CA)

( * ) Notice: Subject to any disclaimer, the term of this patent is extended or adjusted under 35 U.S.C. 154(b) by 0 days.

(21) Appl. No.: 11/213,002

(22) Filed: Aug. 25, 2005

(65) Prior Publication Data

US 2007/0044197 A1 Mar. 1, 2007

(51) Int. Cl.
*A41D 13/00* (2006.01)

(52) U.S. Cl. ..... 2/69; 182/3

(58) Field of Classification Search ..... 2/69, 2/81, 94, 79, 227, 97, 69.5, 456, 305, 310; 182/3–7; 244/151 R, 143
See application file for complete search history.

(56) References Cited

U.S. PATENT DOCUMENTS

| | | | | |
|---|---|---|---|---|
| 2,979,153 | A * | 4/1961 | Hoagland et al. | 182/3 |
| 4,449,253 | A * | 5/1984 | Hettinger | 2/93 |
| 4,854,418 | A * | 8/1989 | Hengstenberger et al. | 182/3 |
| 5,297,295 | A * | 3/1994 | Barbeau et al. | 2/96 |
| 6,205,584 | B1 | 3/2001 | Yocca | |
| 6,658,666 | B2 * | 12/2003 | Schweer | 2/94 |
| 6,668,386 | B2 * | 12/2003 | Vidal | 2/100 |

* cited by examiner

*Primary Examiner*—Tejash Patel
(74) *Attorney, Agent, or Firm*—Dorsey & Whitney LLP

(57) ABSTRACT

The present invention provides a protective garment that comprises a torso portion for being positioned around a wearer's torso, a collar portion extending from the torso portion, and a security device. The collar portion includes an opening through which the security device extends. The security device comprises a harness portion located on a first side of the opening, and a manual activation portion located on a second side of the opening for enabling a wearer of the garment to be dragged.

20 Claims, 5 Drawing Sheets

PROTECTIVE GARMENT HAVING A DRAG AND RESCUE DEVICE ACCESSIBLE FROM THE COLLAR

FIELD OF THE INVENTION

The present invention relates to the field of protective garments, and more particularly to protective garments that include security drag and rescue harnesses.

BACKGROUND OF THE INVENTION

Firefighters are often exposed to very dangerous situations during the course of their work. Not only are they exposed to the immediate danger of the fire they are trying to put out, they are also exposed to other dangers such as falling objects, explosions, and hazardous debris, that are often present at emergency scenes. As such, it is not uncommon for these additional dangers to cause one or more firefighters to become incapacitated and/or rendered unconscious during the course of responding to an emergency situation.

When a firefighter is down, meaning that he is unconscious or otherwise incapacitated, it is desirable that his fellow firefighters can get him out of the dangerous situation so that he is not exposed to any further harm. As such, many protective garments for firefighters are equipped with drag and rescue devices that can be used by a rescuer to drag a downed firefighter to safety.

For example, one such drag and rescue device is the Yoc-Strap™ which is described in U.S. Pat. No. 6,205,584, issued to Yocco. This strap is fitted into the firefighter's coat and includes a drag loop that is accessible from the exterior of the coat. The drag loop can be grasped and pulled by a rescuer in order to cause a harness to secure around the wearer's arms and shoulders. As such, the harness supports the wearer's body as the rescuer drags the incapacitated firefighter to safety.

A deficiency with this device, however, is that it is located at the base of the coat's collar. Often, when a firefighter is incapacitated, it is difficult for a rescuer to access the base of the wearer's collar due to the firefighter's position, or due to the fact that the base of the collar is obstructed by the firefighter's breathing apparatus.

In light of the above, it can be seen that there is a need in the industry for a protective garment that alleviates, at least in part, the deficiencies of the prior art.

SUMMARY OF THE INVENTION

In accordance with a first broad aspect, the present invention provides a protective garment that comprises a torso portion for being positioned around a wearer's torso, a collar portion extending from the torso portion, and a security device. The collar portion includes an opening through which the security device extends. The security device comprises a harness portion located on a first side of the opening, and a manual activation portion located on a second side of the opening.

In accordance with a second broad aspect, the present invention provides a protective garment that comprises a torso portion for being positioned around a torso of a wearer, a pair of sleeves and a collar portion extending from the torso portion, and a drag harness. The collar portion includes an opening. The drag harness comprises first and second loop portions positionable within the protective garment adjacent respective ones of the pair of sleeves and a drag loop interconnecting the first and second loop portions. The drag loop extends through the opening in said collar portion. Each of the first and second loop portions is movable from a first position to a second position in response to the pulling of the drag loop.

In accordance with another broad aspect, the present invention provides a garment that comprises torso covering means for being positioned around at least a portion of a torso of a wearer, collar means and drag and rescue means. The torso covering means includes an interior side and an exterior side. The collar means extends from the torso covering means and includes an opening. The drag and rescue means extends through the opening of the collar means and comprises harness means and manual activation means. The harness means are located on the interior side of the torso covering means and the manual activation means located on the exterior side of said torso covering means. The manual activation means is operative for being pulled so as to cause the harness means to tighten around a wearer's body.

These and other aspects and features of the present invention will now become apparent to those of ordinary skill in the art upon review of the following description of specific embodiments of the invention and the accompanying drawings.

Other aspects and features of the present invention will become apparent to those ordinarily skilled in the art upon review of the following description of specific embodiments of the invention in conjunction with the accompanying figures.

DETAILED DESCRIPTION

Figure 1:
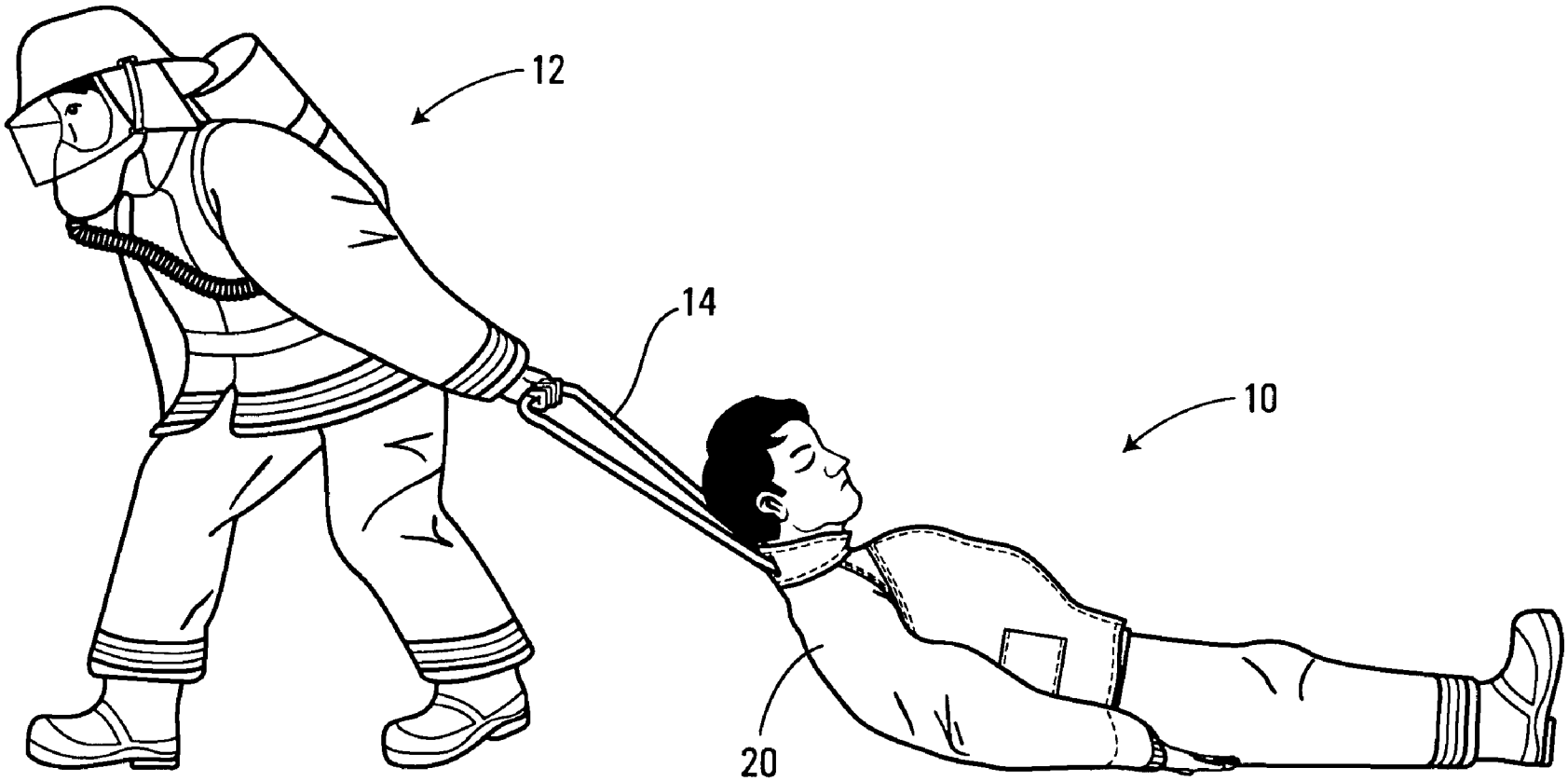
FIG. 1 shows a downed firefighter being rescued by a fellow firefighter via a drag and rescue device according to the present invention.

Shown in FIG. 1 is an incapacitated firefighter 10 wearing a coat 20 that includes a drag and rescue security device 14 in accordance with a non-limiting example of the present invention. When the firefighter 10 is incapacitated, the security device 14 is operative to be deployed by a rescuer 12 for enabling the rescuer to drag the downed firefighter 10 to safety.

Figure 2:
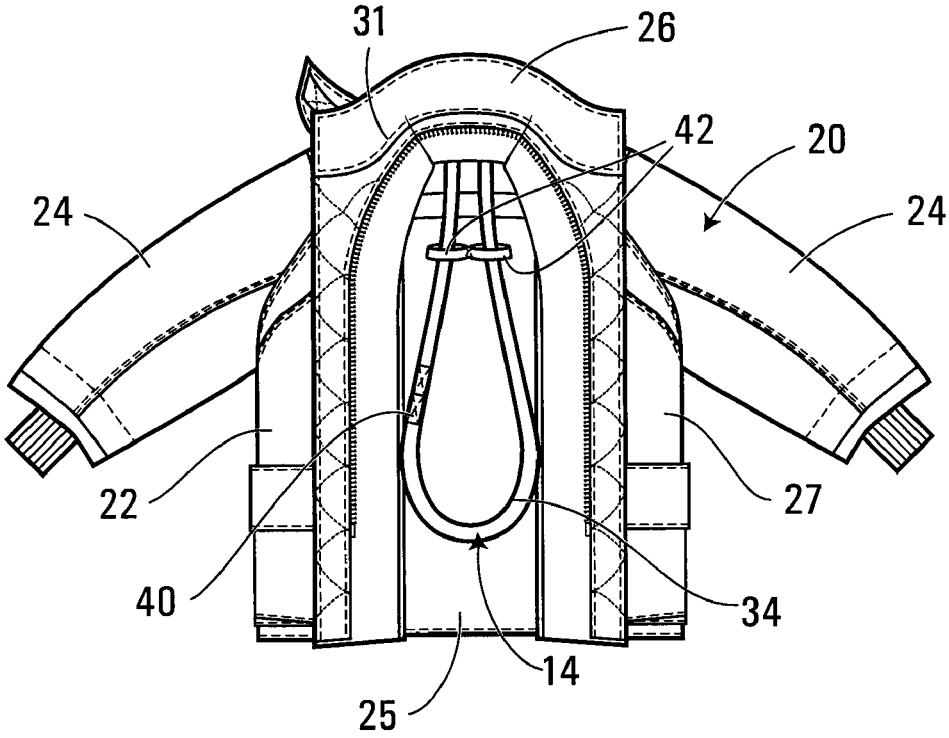
FIG. 2 shows a front plan view of a garment comprising a security device in accordance with a non-limiting example of implementation of the present invention.

Shown in FIG. 2, is a front view of the coat 20 in accordance with a non-limiting example of implementation of the present invention. The coat 20 includes a torso portion 22, a pair of sleeves 24, a collar portion 26 and a drag and rescue security device 14. The torso portion 22 is suitable for covering a wearer's torso, and defines an interior side 25 and an exterior side 27. The pair of sleeves 24 and the collar portion 26 extend from the torso portion 22.

More specifically, the collar portion 26 extends about a neck opening of the coat 20. In the non-limiting embodiments shown in FIGS. 2 and 3, the collar portion 26 is formed of a separate piece of material that is connected to the torso portion 22 via stitching 31. It should be understood, however, that the collar portion 26 could be a continuous piece of material that extends upwards from the torso portion 22. For the purposes of the present description, the collar portion 26 is the portion of the coat 20 that is operative for covering at least a portion of the wearer's neck, or for folding over at least a portion of the torso portion 22 of the coat 20.

Figure 3:
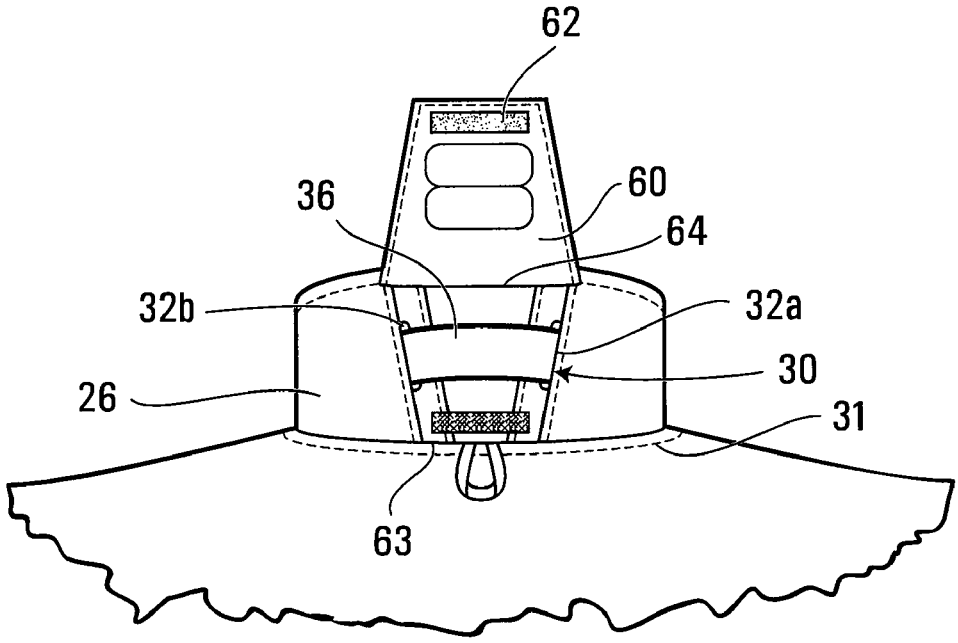
FIG. 3 shows a back cut-away view of the collar of the garment shown in FIG. 1.
Figure 4:
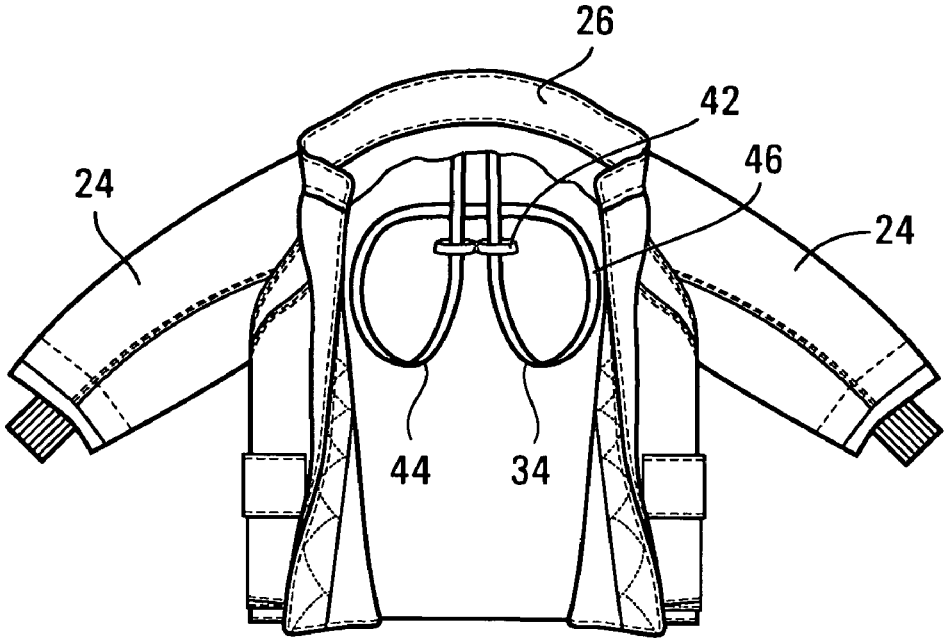
FIG. 4 shows a front view of the garment and security device of FIG. 2.

In accordance with the present invention, and as best shown in FIG. 3, the collar portion 26 includes an opening 30 through which the security device 14 can extend. In the non-limiting embodiment shown, the opening 30 includes a first slit 32*a* and a second slit 32*b*. It should be appreciated however that the opening 30 may include only a single slit, aperture or hole. The collar portion 26 includes a lower edge portion 63 that is proximate to the torso portion 22 and has an upper edge portion 64 with the opening 30 defined between the lower edge portion 63 and the upper edge portion 64 as shown in figure 3.

As shown in FIGS. 2 and 3, the drag and rescue security device 14 includes a harness portion 34 positioned within the interior side 25 of the coat 20, and a manual activation portion 36 positioned on the exterior side 27 of the coat 20.

In the non-limiting example shown in FIG. 3, the manual activation portion 36 of the safety device 14 is in the form of a drag loop that is formed by a strap that extends from the first slit 32*a* over the exterior of the collar to the second slit 32*b*. As will be described below, the drag loop can be grabbed and pulled by a rescuer in order to deploy the harness portion 34 of the safety device 14.

Although a drag loop is shown in FIG. 3, it should be appreciated that the manual activation portion 36 of the security device 14 can be of many different forms and configurations. For example, in a first alternative example, the manual activation portion 36 may be in the form of a fire and flame resistant material or handle that is connected to the harness portion 34 via a single cord. In such a case, the collar portion 26 of the coat may include only a single slit such that the handle is positioned on the exterior side 27 of the collar, with the single cord passing through the single slit, thereby connecting the handle to the harness portion 34 positioned within the interior side 25 of the coat 20.

In yet another alternative embodiment, the manual activation portion 36 may be in the form of a large loop formed from a strap of material such as the one shown in FIG. 3. In such an embodiment, the collar portion 26 may include only a single slit, such that the loop is positioned on the exterior side 37 of the coat 20, and the two ends of the loop would pass through the single slit to the harness portion 34 thereby connecting the loop to the harness portion 34 positioned within the interior side 25 of the coat 20. The strap could be formed into a knot between the harness portion 34 and the loop of the manual activation portion 36, such that the loop would remain on the exterior side 27 of the coat due to the fact that the knot is too large to pass through the slit. In order to deploy the harness portion 34 of the security device 14, a rescuer would simply need to grab and pull the loop.

Regardless of the shape and configuration of the manual activation device 36, it should be suitable for supporting the body weight of a wearer of the coat 20. In this manner, the manual activation device 36 can be pulled by a rescuer, and used to drag the wearer of the safety device 14 to safety, without the manual activation device 36 breaking under the weight of the user.

As mentioned above, the harness portion 34 of the security device 14 is adapted for being positioned within the interior side 25 of the coat 20, such that it can be in proximity to the torso of a wearer of the coat. When a wearer pulls on the manual activation device 36, the harness is operative to capture at least a portion of the wearer's body so as to create a drag harness that is able to support the wearer's body when the wearer is being dragged to safety.

In the non-limiting example of implementation shown in FIG. 2, the harness portion 34 of the safety device 14 is in the form of a strap that extends down from the two slits 32*a* and 32*b* (not shown) in the collar portion 26. More specifically, in accordance with the non-limiting embodiment shown, both the harness portion 34 and the manual activation portion 36 are formed of a single strap of material. Preferably, the strap of material is made of a strong, fire-resistant material.

In order to form both the manual activation portion 36 and the harness portion 34, one end of the strap of material is threaded through the slits 32*a* and 32*b* in the collar portion 16, so as to form the drag loop as described above. Then, the two ends of the strap are joined together at a connection region 40, as shown in FIG. 2, in order to form the harness portion 34. In a non-limiting example of implementation, the connection region 40 can include stitching, and/or tacking, such that the two ends of the strap are permanently joined together. Alternatively, the connection region 40 can include buttons and/or poppers such that the two ends of the straps are not permanently attached, and can be disconnected in the case where the security device 14 needs to be removed from the coat 20. It should however be appreciated that however the two ends of the strap are connected, it should be a strong enough connection to support the body weight of the wearer of the coat 20.

As shown in FIG. 2, once the strap has been looped through slits 32*a* and 32*b* and connected at connection region 40, the harness portion 34 simply hangs down within the interior side 25 of the coat 20. In the non-limiting embodiment shown, the coat 20 includes two positioning loops 42 within the interior side 25 of the coat 20 for keeping the harness portion 34 in place.

In order to create a drag harness that will be able to tighten around the wearer's body, the lower end of the harness portion 34 is moved upwards, and positioned behind positioning loops 42, thereby forming first and second loop portions 44 and 46. In order to position the strap behind the positioning loops 42, the first and second loop portions 44 and 46 may need to be formed prior to connecting the two ends of the strap together at the connection region 40.

Connecting the two loop portions 44 and 46 is a cross strap 47. The cross strap 47 extends along the interior side 25 of the torso portion 22 of the coat 20. This cross strap 47 will provide additional support to the wearer's body in the case where the security device 14 is used to drag the wearer to safety.

As shown, the first and second loop portions 44 and 46 are positioned adjacent respective ones of the pair of sleeves 24, such that they can receive the wearer's arms when the wearer's arms are placed within the pair of sleeves 24. The manner in which the first and second loops 44 and 46 are positioned adjacent the opening to the sleeves 24 can be done in a plurality of ways. For example, the interior side 25 of the coat 20 may include additional positioning loops (not shown) surrounding the entrance to the sleeves 24. As such, the loop portions 44 and 46 can be inserted within these positioning loops such as to keep them in place adjacent to the entrance of the sleeves 24. In this manner, when a wearer places his/her arms into the respective sleeves 24, their arims are automatically put through the first and second loops 44 and 46.

Figure 5:
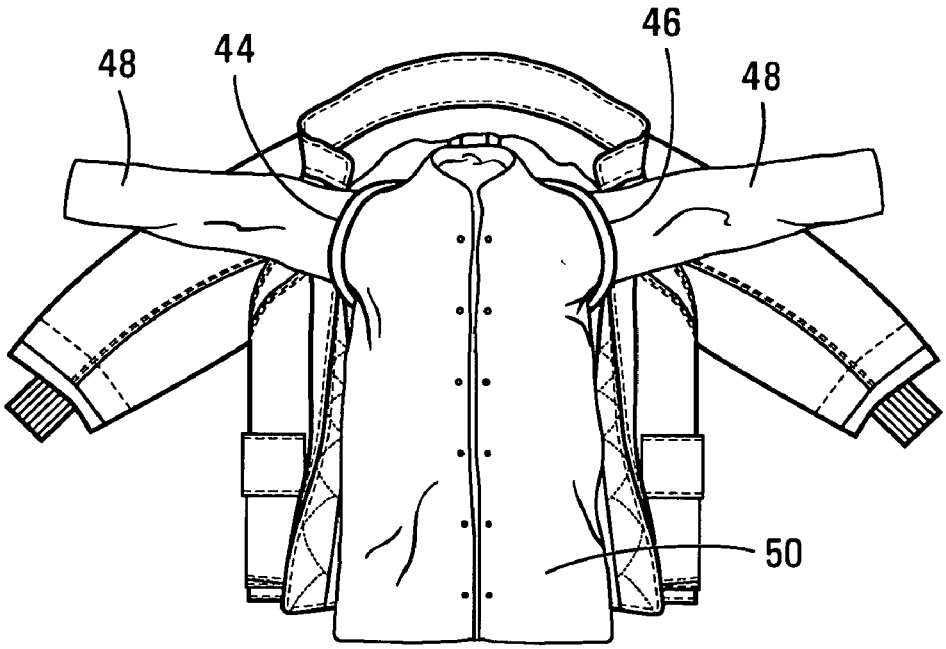
FIG. 5 shows a front view of the garment and security device of FIG. 4 with an inner lining in accordance with a non-limiting example of implementation of the present invention.
Figure 6:
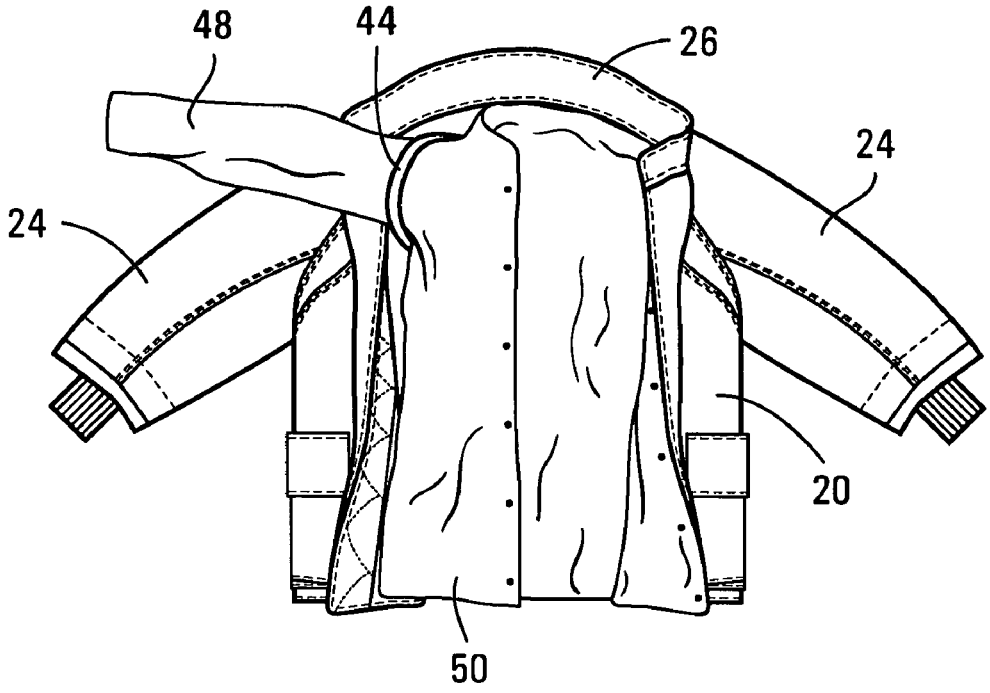
FIG. 6 shows a front view of the garment, inner liner and security device of FIG. 4 in a partially assembled state.
Figure 7:
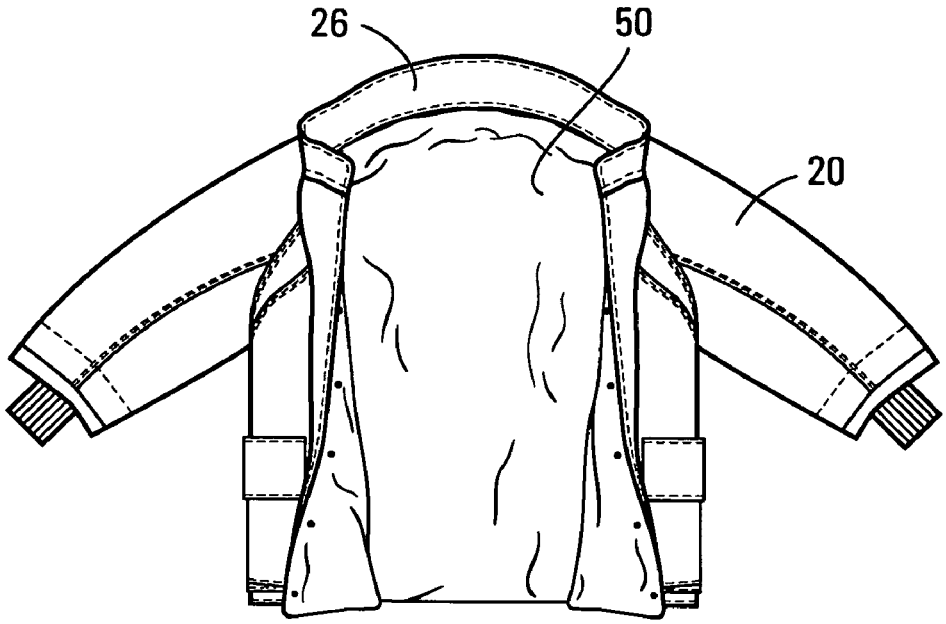
FIG. 7 shows a front view of the garment of FIG. 4 when the security device is positioned between the inner liner.

Alternatively, in the non-limiting embodiment shown in FIG. 5, the coat 20 includes an inner lining 50. In this embodiment, the first and second loop portions 44 and 46 are positioned around the sleeves 48 of the inner lining 50. As shown in FIG. 6, the sleeves 48 of the inner lining 50 are then inserted into the sleeves 24 of coat 20. In this manner, the harness portion 34 of the safety device 14 is positioned between the inner lining 50 and the coat 20. As such, when the inner lining 50 and the outer coat 20 are assembled, as shown in FIG. 7, the wearer cannot tell that there is a safety device 14 positioned between the torso portion 22 of the coat and the inner lining 50. Therefore, when the wearer places his/her arms within sleeves 48 and 24 simultaneously, the first and second loop portions 44 and 46 automatically receive the wearer's arms.

In normal operation, when the wearer of the coat is conscious and able-bodied, the manual activation portion 36 of the safety device 14 is in the non-deployed position, which is the position shown in FIG. 3. Likewise, the harness portion 34 of the safety device is in a normal position. When the harness portion 34 is in the normal position, the firefighter can go about his/her normal tasks without being constrained by the harness portion 34. In most cases, the firefighter will not even notice that the harness portion 34 is present.

However, in the case where a firefighter is knocked unconscious, or is incapacitated in any other manner, a rescuer activates the manual activation portion 36 by pulling on it firmly. The act of pulling on the manual activation portion 34 causes the harness portion 34 to tighten around at least a portion of the wearer's body so as to create a drag harness that is able to help a rescuer drag the downed firefighter to safety. While the firefighter is being dragged to safety using the security device 14, the coat 20 stays on the wearer, thereby protecting the wearer from debris on the ground.

When rescuing a downed firefighter, the rescuer must be able to access the manual activation device 36 relatively easily. As described above, the opening 30 through which the manual activation device 36 extends is located in the collar portion 26 of the coat. An advantage of placing the manual activation device 36 in the collar portion 26 is that it is almost always accessible to a rescuer, regardless of the position of the incapacitated firefighter, and regardless of the type of equipment the firefighter is wearing.

In the case where the harness portion 34 is formed of a single strap, as described above, when the rescuer pulls on the manual activation portion 36, the first and second loop portions 44 and 46 of the harness portion 34 tighten around the wearer's arms and shoulders. This not only provides support for the downed firefighter while being dragged, but also increases the length of the manual activation portion 36 that extends from the opening 30 in the collar. This length makes it easier for the rescuer to drag the downed firefighter.

Although the harness portion 34 shown in FIGS. 2, 4, 5 and 6 is formed of a single strap of material, it should be appreciated that other types of harnesses can also be included within the spirit of the invention. For example, the harness could be in the form of a vest that replaces the inner coat portion 50. Or the harness could include a plurality of straps, some of which extend across the wearer's chest. Any harness that can move from a normal position to a rescue position upon deployment of a manual activation portion that is situated in the collar portion 26 of the coat 20, is included within the scope of the present invention.

In accordance with a non-limiting embodiment of the invention, and as shown in FIG. 3, the collar portion 26 of the coat 20 includes a flap 60 for covering the manual activation portion 36 of the safety device 14 when not in use. In this manner, the flap 60 helps to protect the manual activation portion 36 from getting damaged during the course of normal wear.

Figure 8:
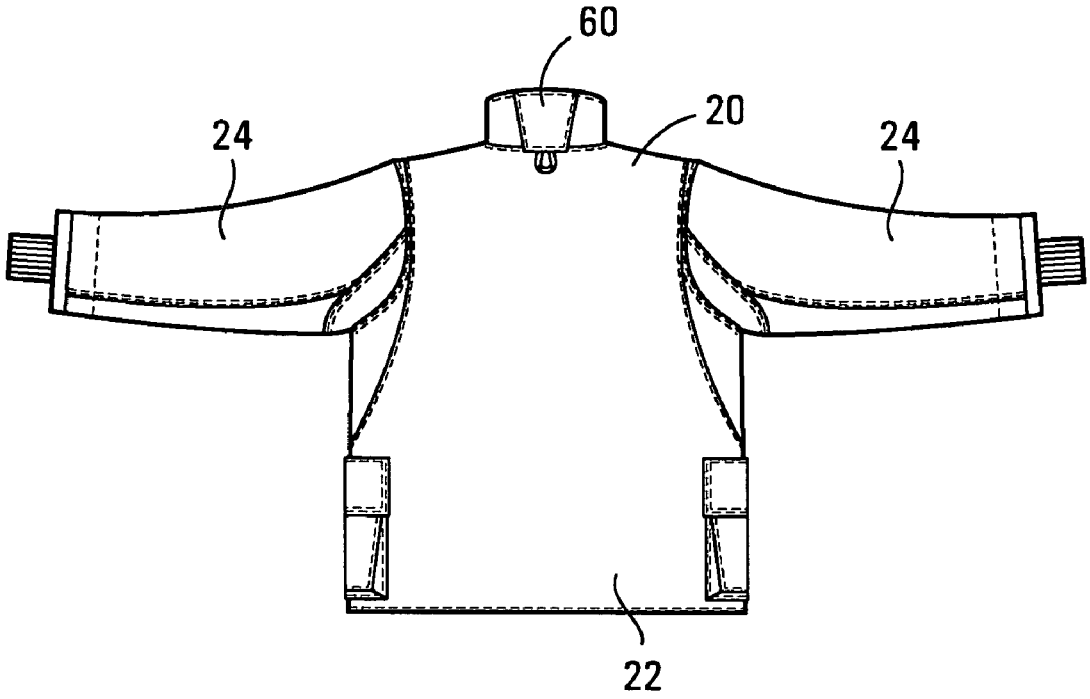
FIG. 8 shows a back plan view of the garment of FIG. 2.

The flap 60 is shown in the open position in FIG. 3, and in the closed position in FIG. 8. The flap 60 can be of any shape and size suitable for covering the manual activation portion 36. In addition, the flap can include a closing mechanism 62 that is suitable for keeping the flap 60 in the closed position when it is not necessary to access the manual activation portion 36. In the non-limiting embodiment shown in FIG. 3, the closing mechanism 62 is in the form of a hook and loop fastener, such as Velcro™. It should however be appreciated that any other type of closing mechanism, such as buttons or poppers that are known in the art could also be used without departing from the spirit of the invention.

In a further non-limiting example of implementation, the flap 60 can include text advising of the location of the safety device 14. In this manner, a rescuer will know that the coat includes a safety device 14, and that the safety device 14 can be accessed via the collar portion 26.

Although the coat 20 has been described above as being suitable for being worn by a firefighter, it should be appreciated that garments that include such a security device may also be used for soldiers, construction workers, and other emergency responders. In addition, the drag and rescue security device 14 can also be included in garments such as vests and sweaters.

Although the present invention has been described in considerable detail with reference to certain preferred embodiments thereof, variations and refinements are possible without departing from the spirit of the invention. Therefore, the scope of the invention should be limited only by the appended claims and their equivalents.

The invention claimed is:

1. A protective garment comprising:

a) a torso portion for positioning around a torso of a wearer;

b) a collar portion extending from said torso portion adapted to cover at least a portion of a wearer's neck, said collar portion having an upper edge portion and a lower edge portion, said lower edge portion being in proximity to said torso portion, said collar portion including an opening positioned between said lower edge portion and said upper edge portion; and c) a security device extending through said opening of said collar, said security device comprising:

i) a harness portion located on a first side of said opening, said harness portion being operative for moving from a regular position to a rescue position, wherein said harness portion forms a drag harness when in the rescue position; and ii) a manual activation portion located on a second side of said opening, said manual activation portion being operative for causing said harness portion to move from the regular position to the rescue position.

2. A protective garment as defined in claim 1, wherein said torso portion comprises an interior side and an exterior side, said harness portion being located on said interior side and said manual activation portion being located on said exterior side.

3. A protective garment as defined in claim 2, wherein said manual activation portion is a drag loop suitable for being pulled by a user for causing said harness portion to move from the regular position to the rescue position.

4. A protective garment as defined in claim 3, wherein said harness portion is operative for being positioned around at least a portion of the wearer's body when in said rescue position.

5. A protective garment as defined in claim 3, wherein said drag loop is suitable for supporting a person's body weight.

6. A protective garment as defined in claim 5, wherein said security device is formed from a single strap.

7. A protective garment as defined in claim 6, wherein said single strap is made of flame resistant material.

8. A protective garment as defined in claim 1, further comprising a pair of sleeves that extend from said torso portion, said harness portion including first and second loop portions suitable for being positioned in proximity to said sleeves for receiving a wearer's arms when placed within said pair of sleeves.

9. A protective garment as defined in claim 8, wherein said first and second loop portions tighten around the wearer's arms when said manual activation device is grasped and pulled.

10. A protective garment as defined in claim 1, comprising an inner lining, said harness portion being positioned between said torso portion and said inner lining.

11. A protective garment as defined in claim 1, wherein said collar portion further includes a flap portion for covering said manual activation portion.

12. A protective garment as defined in claim 1, wherein said protective garment is a coat suitable for being worn by a firefighter.

13. A protective garment comprising:

a) a torso portion for positioning around a torso of a wearer;

b) a pair of sleeves extending from said torso portion;

c) a collar portion extending from said torso portion adapted to cover at least a portion of a wearer's neck, said collar portion having an upper edge portion and a lower edge portion, said lower edge portion being in proximity to said torso portion, said collar portion including an opening positioned between said lower edge portion and said upper edge portion; and d) a drag harness comprising:

i) first and second loop portions positionable within said protective garment adjacent respective ones of said pair of sleeves;

ii) a drag loop interconnecting said first and second loop portions and being extendable through said opening in said collar portion; and iii) wherein each of said first and second loop portions is movable from a first position to a second position in response to the pulling of said drag loop.

14. A protective garment as defined in claim 13, wherein in said first position said first and second loop portions enable the wearer's arms to pass through said pair of sleeves, and wherein in said second position said first and second loop portions tighten around the wearer's arms and shoulders.

15. A protective garment as defined in claim 14, wherein said drag harness is formed from a single strap.

16. A protective garment as defined in claim 15, wherein said single strap is made of a flame resistant material.

17. A garment as defined in claim 13, wherein said protective garment includes an inner liner, said drag harness being positioned between said torso portion and said inner liner.

18. A garment as defined in claim 13, wherein said collar portion further includes a flap portion for covering said drag loop.

19. A garment as defined in claim 13, wherein said protective garment is a coat for being worn by a firefighter.

20. A garment comprising:

a) a torso covering arrangement adapted for being positioned around at least a portion of a torso of a wearer, said torso covering arrangement including an interior side and an exterior side;

b) a collar arrangement extending from said torso covering arrangement adapted to cover at least a portion of a wearer's neck, said collar arrangement having an upper edge portion and a lower edge portion, said lower edge portion being in proximity to said torso covering arrangement, said collar arrangement including an opening positioned between said lower edge portion and said upper edge portion; and c) a drag and rescue arrangement extending through said opening of said collar arrangement, said drag and rescue arrangement comprising:

i) a harness arrangement located on said interior side of said torso covering arrangement, said harness arrangement being operative for moving from a regular position to a rescue position, wherein said harness arrangement forms a drag harness when in the rescue portion; and ii) a manual activation arrangement located on said exterior side of said torso covering arrangement, said manual activation arrangement being operative for being pulled so as to cause said harness arrangement to move into said rescue position wherein said harness arrangement tightens around a wearer's body for creating said drag harness.

* * * * *